United States Patent [19]

Sano

[11] 4,401,305

[45] Aug. 30, 1983

[54] SIMULATED RACING GAME

[75] Inventor: Hiroshi Sano, Tokyo, Japan

[73] Assignee: Tomy Kogyo Company, Inc., Japan

[21] Appl. No.: 258,582

[22] Filed: Apr. 29, 1981

[30] Foreign Application Priority Data

May 31, 1980 [JP] Japan ..... 55-76236

[51] Int. Cl.[3] ..... A63F 9/14

[52] U.S. Cl. ..... 273/86 F; 46/202

[58] Field of Search ..... 273/1 G, 1 GC, 1 GE, 273/86 R, 86 B, 86 F, 86 G; 46/202, 206

[56] References Cited

U.S. PATENT DOCUMENTS

| | | | |
|---|---|---|---|
| 1,697,701 | 1/1929 | Wallace | 273/86 FU X |
| 2,224,799 | 12/1940 | Schmid . | |
| 2,225,502 | 12/1940 | Lauterbach | 273/86 F |
| 2,230,563 | 2/1941 | Garms et al. | 273/86 F |
| 2,602,262 | 7/1952 | Nichols . | |
| 3,552,322 | 1/1971 | Clowes | 273/86 F |
| 3,628,725 | 12/1971 | Edwards et al. | 273/86 R |
| 3,827,693 | 8/1974 | Barlow et al. | 273/86 F |
| 3,860,237 | 1/1975 | Cooper et al. | 273/86 R |
| 3,948,520 | 4/1976 | Barlow | 273/86 F |
| 3,986,296 | 10/1976 | Hamano | 273/86 B X |
| 4,147,351 | 4/1979 | Saito | 273/86 B |

*Primary Examiner*—Anton O. Oechsle

*Attorney, Agent, or Firm*—K. H. Boswell; Edward D. O'Brian

[57] ABSTRACT

A race game of the type wherein a housing has a surface with two channels located therein with an endless belt moving in each of the channels is improved by attaching to one of the endless belts a first upstanding member and attaching to the second endless belt at least one second upstanding member. Portions of the first and second upstanding members project upwardly from the surface. A motor is located in the housing and connects to the first and second endless belts. The motor drives the endless belts which in turn moves the first and second members in continuous pathway over the surface. At one point on the surface the continuous pathways converge toward each other and at another point they diverge. The first and second members are each capable of engaging with a portion of a small wheeled race vehicle and pulling these vehicles across the surface. Where the pathways converge one of the small vehicles is capable of striking and dislodging the other of the small vehicles from the member to which it is attached. Included as part of the game is a speed regulating system wherein the speed of one of the endless belts can be regulated such that the vehicle attached to it can go faster than, at the same speed as or slower than the other vehicle. This allows the operator of the game to control the vehicle attached to the regulated endless belt to avoid dislocation of the controlled vehicle off of its driving member by preventing interaction of the two vehicles.

15 Claims, 7 Drawing Figures

40
24
48
20
2
22
12
38
16
18
48
48
36
34
48
32
2
30
28
26
70
58
14

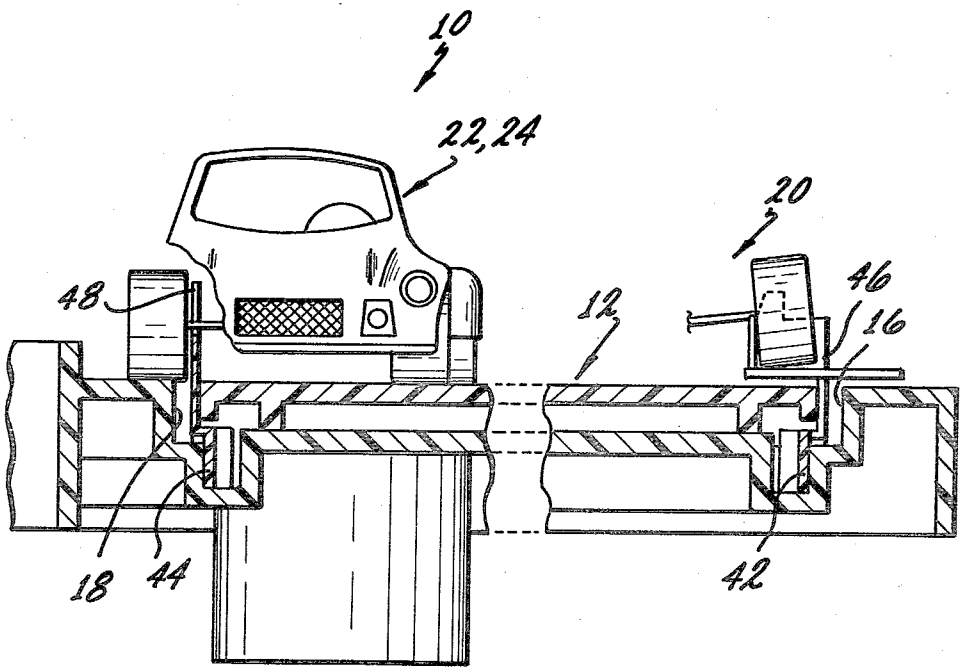
FIG. 2
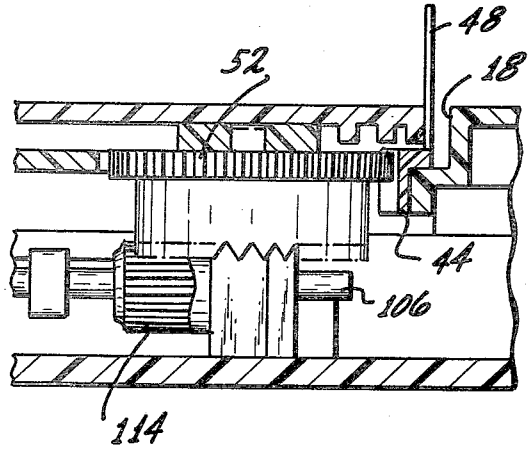

SIMULATED RACING GAME

BACKGROUND OF THE INVENTION

This invention is directed to a toy race game of the type wherein a surface includes two depressed channels with each of the channels incorporating an endless belt therein which are driven in a continuous path in the channel. Attaching to each of the endless belts is an upstanding driving member which projects upwardly beyond the surface. The driving members are capable of engaging portions of small wheeled vehicles to drive or pull these members across the surface. The channels are so shaped such that the vehicles will converge for one portion of the surface and diverge away from each other over the remaining portion. In that portion wherein the vehicles can converge one of the vehicles is capable of dislocating the other vehicle from its driving member thus severing the driving connection to this vehicle and stopping the progress of this vehicle.

A large number of children's games exists which are based on movement of a vehicle over a track, surface or the like. These were first expressed in the form of miniature railroads wherein a train having an electric motor was powered over a track. Electric current to drive the motor was supplied to the train through the individual rails of the track. This type of propelled vehicle was later expanded to include so called "slot car racers." In this type of game the wheels of the vehicle were freed from tracks, however, the vehicles still depended upon engagement with a slot to receive appropriate electrical current to power the vehicle. Beginning about 40 years ago it became evident that a second type of power system could be used to drive a vehicle around a pathway. This was based on utilization of a moving endless element depressed beneath the surface of a track.

U.S. Pat. No. 2,224,799 which issued in 1940 describes an early rendition of the movable vehicle described in the preceding sentence. In this patent an endless chain, composed of a plurality of individually linked sections, moved about a pathway depressed beneath the surface. The chain was driven by an appropriate cog wheel which engaged the chain. A vehicle resting on the surface incorporated a plurality of downwardly projecting bosses which engage the chain and when so engaged the chain would propel the vehicle around the surface minicking the pathway of the chain in a depressed channel. The game described in this patent utilized but a single endless element and a single channel thus one or more vehicles moving over this channel were always fixed with respect to one another and a race type situation was not developed.

In U.S. Pat. No. 2,602,262 the endless chain was replaced by a belt which was driven around a complex cloverleaf like pattern. Simulation of a traffic intersection was achieved by utilizing a switching means which allowed a vehicle having a downwardly projecting engagement member which engaged the belt to either follow the belt as it curved at the intersection or to be disengaged from the belt and travel over the intersection and then reengage the belt. As in previously described patent the game described in this patent did not allow for simulation of a racing situation since only a single endless belt was used.

In U.S. Pat. No. 3,552,332 a racing situation or at least a competitive situation was achieved by incorporating two depressed channels each having an endless drive element composed of a plurality of spheres interconnected by a plurality of rods. Essentially this drive element was an endless elongated rendition of an old fashioned key or bathroom stopper chain. The vehicles used on this game also incorporated downwardly projecting bosses which were fixed to the vehicle and went into a channel and engaged the chain. In this patent motors were used to drive the endless chain and appropriate speed governing mechanisms could be utilized to control the speed. The two tracks utilized in this patent are placed one inside the other such that the outside track would require a longer endless chain than the inside track and as a consequence the vehicle engaged with the outside track would require a longer period of time to circumvent the oval of the track if in fact the chains were going at the same speed. It can be seen that this type of game has an inherent disadvantage in that the person controlling the vehicle on the inside track could complete more complete revolutions of the oval of the track given any particular maximum speed of his endless chain with respect to the maximum speed of the other endless chain.

U.S. Pat. No. 3,986,296 describes a similar type game, however, instead of a direct engagement of the movable vehicles with the endless element a magnetic coupling was utilized. In order to compensate for the smaller pathway of the inside track with respect to the outside track the magnetic coupling member attached to the endless element was pivotly attached to the endless element and at certain portions along its pathway it was frictionally engaged against a surface as it moved thus spinning it about its pivot. This changed the relationship of the coupling magnets with respect to one another which in turn changed the relationship of the vehicles magnetically attached to these magnets. This game incorporated a degree of suspense and variety more adequately simulating a race situation, however, skill of the operator of the game was ignored and the movement of the race vehicles with respect to one another was totally left to chance depending upon rotation of the driving magnets when the frictional surfaces were engaged.

In U.S. Pat. No. 3,948,520 an additional racing type game is described. In place of vehicles the objects moved represent roller skaters participating in a roller derby game. Three endless elements are utilized in this game spaced with respect to one another such that the outer two elements were driven in conjunction with each other and the middle element was driven independently. In this way a challenge situation could be created between the operator of the middle element and the operator of the outer and innermost element. The tracks, or channels, in which the moving endless elements were embedded therein were given a plurality of bends so at some points they approached each other and at some points they diverged from each other. The playing pieces used on this game as with most of the previously described vehicles incorporated downwardly projecting bosses from the playing pieces. These engaged the endless element and thus the playing pieces were propelled around the track by the endless element. Players of the game attempted to negotiate their pieces such that the pieces of one of the players attempted to dislodge the pieces of the other of one of the players from engagement with the endless element. Electric motors are used to drive the endless elements and two rheostats are provided to drive the two electric motors giving some control of the speed of the elements.

In view of the popularity and the variety of games incorporating endless elements it is evident that these types of games each incorporates certain features which contribute to the play value of the game such that the attention of the child using them is maintained and in certain of these games the game could be used by more than one child thus creating a competitive type spirit with regard to the game. With the exception of the U.S. Pat. No. 3,948,520 noted above, all of the games shown in the other patents could be used by a child by himself. However, none of these games really simulated a racing type situation wherein a chile was challenged to manipulate the pieces by appropriate controls. In the game described in U.S. Pat. No. 3,948,520 a competitive or race type situation was developed, however, in order to adequately simulate a race type situation two players were needed. If one player was left to control both of the rheostats he, of course, would appropriately set one to the benefit of the other and thus the racing type game would be lost. It is only when that game was played by two players could a real racing type situation be developed.

In view of the above it is evident that there exists a need for a new game of the type which incorporates one or more endless elements embedded in a channel beneath the surface of a housing which can be utilized by one individual and is capable of reproducing a racing type situation whereing the individual must compete to manipulate one object in view of the motion of the second object.

BRIEF DESCRIPTION OF THE INVENTION

In view of the above it is a primary object of this invention to provide a game wherein the game can be utilized by a single individual and the game incorporates such features that a racing type situation is developed even when used by a single individual. It is a further object to provide a game which because of its design and structure is economically manufactured and thus is available in an economic manner to the consuming public. It is a further object to provide a game wherein the individual playing the game can, depending on his skill level, appropriately modify the game such that at a first skill level it can be utilized by a fairly unsophisticated individual yet can be modified to higher skill levels such that it is challenging to other individuals.

These and other objects as will become evident from the remainder of this specification are achieved in a game of the type wherein a housing having a surface is provided with at least two channels depressed below said surface and an endless element moves within each of said channels the improvement which comprises: at least one first upstanding member attaching to one of said endless elements and projecting upwardly from one of said channels wherein said one of said endless elements is located, at least a portion of said first upstanding member projecting above said surface; at least one second upstanding member attaching to the other of said elements and projecting upwardly from the other of said channels wherein the other of said elements is located, at least a portion of said second upstanding member projecting above said surface; a motor located in said housing; a first transfer means operatively connected between said motor and said one element and capable of moving said element in said one channel, said first upstanding member moving in a first continuous pathway above said surface in response to movement of said one element; a second transfer means operatively connected between said motor and said other element and capable of moving said other element in said other channel, said second upstanding member moving in a second continuous pathway above said surface in response to movement of said other element; said first and said second continuous pathways converging on a portion of said surface and diverging on the remaining portion of said surface; a first object capable of reversibly connecting to said one upstanding member and being moved over said surface as said one upstanding member moves in response to movement of said one element; a second object capable of reversibly connecting to said second upstanding member and being moved over said surface as said second upstanding member moves in response to the movement of said other element; said first and said second objects capable of interacting on said portion of said surface wherein said first and said second pathways are convergent, said first and said second object incapable of interacting on said portion of said surface wherein said first and said second pathway are divergent; said first transfer means including means capable of regulating the speed of said one of said endless elements in said one channel with respect to the speed of said other of said endless elements in said other channel.

In the preferred embodiment of this game the means for regulating the speed of the one of said elements regulates the speed of that element with respect to the speed of the other element such that the one of said elements is capable of faster rate of travel than the other of said elements, is capable of approximately equal rate of travel of the other of said elements and is capable of a rate of travel sufficiently less than the rate of travel of the other of said elements. Further the second object is capable of severing the reversible connection of the first object with a first upstanding member such that when such connection is severed the first object is no longer driven around the pathway of the first upstanding member. Further an indicating means can be included such that the cycles of the first object over the surface in response to the movement of the first upstanding member through its pathway can be counted to give the user of the game indication of his skill in avoiding interaction of the first and second objects.

The game will include an appropriate switching means allowing it to be switched to an off position, an on position and a regulated on position. In the regulated on position the timer means would be utilized to control the length of time the elements are driven by the motor. In this regulated position, therefore, the user of the game would be attempting to accumulate as large of a tally as possible on the indicating means within the period governed by the timer means.

In the preferred embodiment of the game the first transfer means would include a first gear train and a first drive gear. The motion of the motor would be transferred via the first gear train to the first driving gear which in turn would drive the first element. Likewise a second gear train and a second drive gear would drive the second endless element. The game would include an operator control member wherein the speed of movement of the first element would be regulated by engaging a control gear with a first or second contact gear included in the first drive train. The control gear would be located on a shifting member which would be controlled by the operator control member. Movement of the operator control member would be transferred via the shifting member to regulate the position of the control gear with regard to the first drive train and thus regulate the speed of the first endless element.

A plurality of second upstanding members could be attached to the other endless element. A plurality of second objects could be individually attached to the second upstanding members. The second upstanding members would be appropriately spaced along the other elements such that a variety of different situations could be created by the operator of the game including having two of the second objects in a close relationship such that in those areas of the pathway which are convergent the first object would not be able to fit within the space between the two second objects and in another manner wherein the first object would be able to fit within the space between the second objects. In this manner a racing situation could be achieved wherein the first race car is either prevented or allowed to move inbetween two other race cars during narrow or convergent portions of a race track.

BRIEF DESCRIPTION OF THE DRAWINGS

The invention described in this specification will be better understood when taken in conjunction with the drawings wherein:

FIG. 2 is an elevational view in section about the line 2—2 showing a front elevational view of a portion of the invention;

Figure 1:
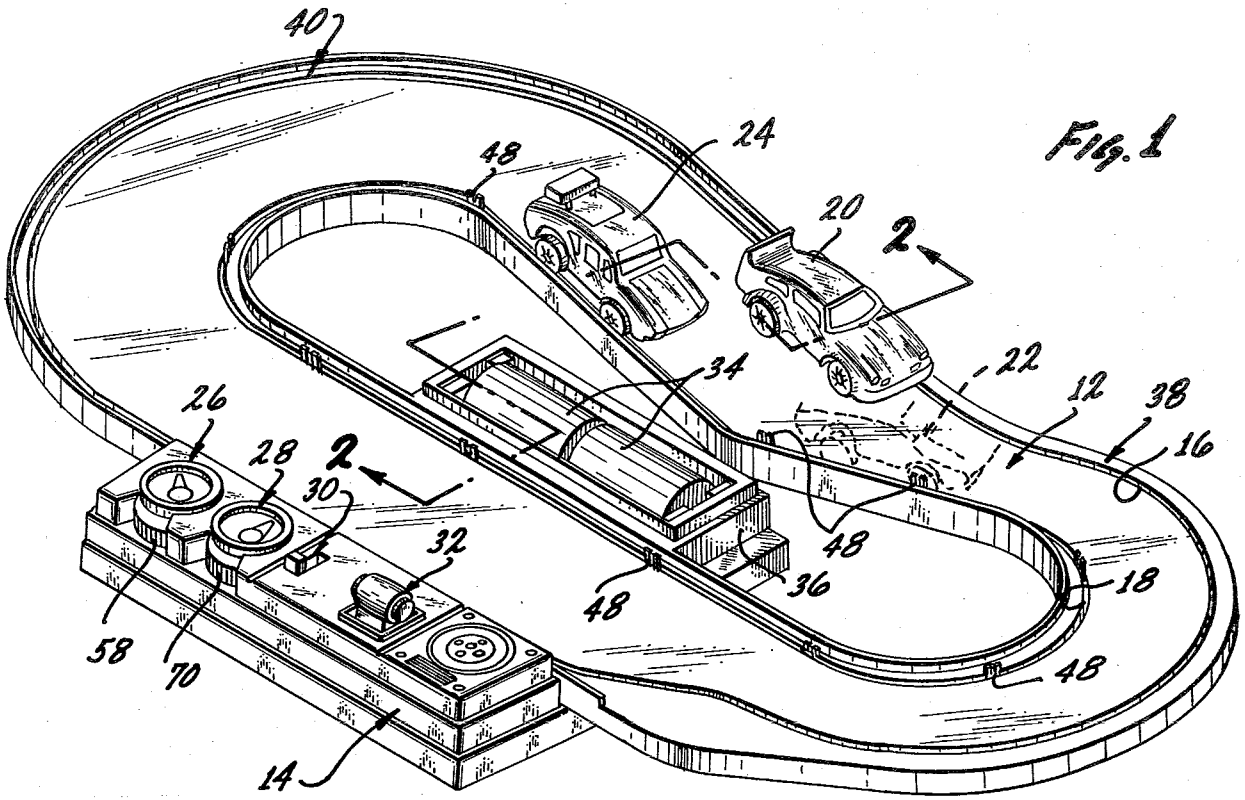
FIG. 1 is an oblique view showing the overall layout of the invention.

The invention described in this specification and shown in the drawings utilizes certain principles and/or concepts as are set forth and claimed in the claims apended to this specification. Those skilled in the toy arts will realize that these principles and/or concepts are capable of being utilized in a variety of embodiments differing from the exact embodiment used herein for illustrative purposes. For this reason this invention is not to be construed as being limited to only the illustrative embodiment herein but is only to be construed in light of the claims.

DETAILED DESCRIPTION OF THE INVENTION

They toy race game 10 of the invention can be broken down into the track portion 12 and the control module portion 14. As seen in FIG. 1 located on the track portion 12 are two curving grooves 16 and 18. Groove 16 is located on the outer section of the track 12 and groove 18 is located within groove 16. In FIG. 1 a vehicle 20 is located adjacent to groove 16 while two vehicles, vehicle 24 in solid lines and vehicle 22 in phantom line are shown located adjacent to groove 18. For the purposes of FIG. 1 the two vehicles 22 and 24 are shown associated with groove 18. The toy race game, however, can be played utilizing only one vehicle 22 or a greater number of vehicles say for example four or five vehicles. In any event the race game 10 will be described in this specification as including either one vehicle 22 adjacent to groove 18 or two vehicles 22 and 24 adjacent to groove 18.

There are several accessible controls and dials located on the control module 14. On the left is a lap counter 26 which counts the number of times vehicle 20 goes around the track portion 12. Next to it is a timer 28 which can be set to control the amount of time available to the operator of the toy to achieve as many laps as possible of vehicle 20. Next to the timer 28 is off/on switch 30 and next to the off/on switch 30 is the control stick 32.

The game is played as follows. The operator of the game after inserting appropriate batteries collectively identified by the numeral 34 in the battery compartment 36, resets the lap counter 26 to zero and the timer 28 to zero and then moves the off/on switch 30 from the off position to either one of the continuous on or the regulated on position. In the continuous on position, the motor of the game as hereinafter described continually drives certain other members hereinafter described continuously around the grooves 16 and 18. In the regulated position the timer 28 comes into effect and these members are driven around the grooves 16 and 18 for a regulated period of time determined by certain gearing as hereinafter explained. For purposes of explaining the game it is assumed that the off/on switch is set to the regulated mode. When this happens the vehicles 20, 22 and 24 for illustrative purposes start cycling around the track 12. Each time the vehicle 20 successfully passes the lap counter 26, the lap counter so indicates a successful conclusion of one complete cycle around the track 12 by the vehicle 20. Concurrently with the movement of vehicle 20 is the movement of the vehicles 22 and 24. These two vehicles maintain a cyclic pace around the track 12 as hereinafter explained.

The right hand portion of the track 12 narrows such that the grooves 16 and 18 comes closer to each other. This is contrasted to the left hand section of the track 12 which is wider and where the grooves 16 and 18 are appropriately spaced further apart. On the right hand section 38 the grooves 16 and 18 can be said to converge toward one another and on the left hand section 40 the grooves 16 and 18 can be said to diverge away from one another. The spacing between the grooves 16 and 18 on the left hand section 40 of the track 12 is such that the vehicles located either adjacent to groove 16 or groove 18 can pass one another without any interaction or interference with each other. Contrast to this, however, on the right hand section 38 of the track 12 the vehicles following next to the grooves 16 and 18 cannot pass one another and in fact will interfere with one another if they are in any way located adjacent to one another as they pass through the right hand section 38.

When the vehicles are in positions shown in FIG. 1 as one of the vehicles 22 or 24 approaches the converging sections of the grooves 16 and 18 at the same time that the vehicle 20 does, the vehicle 20 will be dislodged from a member as hereinafter explained and will no longer continue to be moved around the track 12. If, however, the vehicle 20 approaches and successfully passes through the right section 38 wherein the grooves 16 and 18 converge toward one another without any interference from either of the vehicles 22 or 24 it will successfully pass through this area and can then go on to pass the lap counter 26 and register a successful complete revolution around the track 12.

The game will continue as described above with the operator of the game attempting to accumulate as many laps as possible of vehicle 20 past the lap counter until the timer runs out and at that point the motor driving the components as hereinafter explained will cease to function and the game will stop. At this time the timer and the lap counter can be reset and the game resumed.

During the play of the game the operator of the game can control the speed of movement of vehicle 20 by manipulating the control stick 32. When the control stick 32 is in a neutral or central position the rate of movement of the vehicle 20 closely approximates the rate of movement of the vehicles 22 and 24. Thus as seen in FIG. 1 if the control stick were in its neutral position vehicle 20 would approach and fit inbetween vehicles 22 and 24 as these vehicles entered into the right section 38 of the track 12 and there would be no interference of the vehicle 20 by either of the vehicles 22 or 24.

Having successfully circumvented the right hand section 12 the vehicle 20 then passes the control module 14 and enters into the left hand section 40. At this point the control stick 32 could be depressed away from the track 12 and the vehicle 20 would assume a higher rate of speed than either of the vehicles 22 or 24. This would allow the vehicle 20 to successfully pass the vehicle 22 and get ahead of it and it could continue at this high rate of speed completely around the left hand section 40 and through the right hand section 38 until it approached the rear of the vehicle 24. If, of course, only one vehicle were being used adjacent groove 18 the rear of vehicle 22 would be the limiting factor. In any event when the vehicle 20 approached the rear of one of the vehicles adjacent to groove 18 and both of these vehicles were entering into the right hand section 38 it would be necessary for the operator of the game to release the control stick from the fast mode into the netural position such that the vehicle 20 then once again approximated the speed of the vehicles aligned with groove 18.

Optionally the control stick 32 could be depressed toward the track 12. When this happens the vehicle 20 stops, that is it ceases to revolve around the track 12. It may be necessary to do this in order to avoid a collision with one of the vehicles 22 or 24 or any lesser or greater number of vehicles aligned with groove 18. This in effect corresponds to a braking action in a real race situation whereas the opposite movement of the control stick 32 described above corresponds to an acceleration procedure. In any event the operator of the toy operates the control sticks 32 between the braking position wherein the vehicle 20 ceases to move, the neutral position wherein the vehicle 20 moves at the same rate of speed as the other vehicles and in the accelerating position wherein the vehicle 20 moves faster than any of the other vehicles.

It can be seen by the above explanation of the game that the operator of the game can utilize the game in such a manner that the vehicle 20 actually can simulate the real racing situation wherein its driver would have to brake, accelerate and cruise at the constant speed and the like. Instead of playing against the timer 28 the off/on switch could be set to the continuous on mode and then operator would then continue driving his vehicle 20 for as long a period of time as he desires trying to avoid any other vehicles and to accumulate the maximum number of laps on the lap counter 26.

Located within groove 16 is an endless belt 42. Located within groove 18 is an endless belt 44. Endless belt 42 drives the one vehicle 20 in the circulatory manner about the track 12 whereas endless belt 44 drives the other vehicles. As seen in FIG. 2, attaching to and projecting upwardly through groove 16 such that a portion of it is located above the track 12 is an engagement member 46. The front left hand wheel of the vehicle 20 fits into and is held by the engagement member 46. By this attachment the vehicle 20 is pulled along by the endless belt 42.

Projecting upwardly from endless belt 44 are a plurality of engagement members collectively identified by the numeral 48. The veicles 22 and 24 as well as other similar vehicles can be engaged in conjunction with endless belt 44 by engaging their right front wheel with one of the engagement members 48. As can be seen in FIG. 1 the engagement members 48 are symetrically spaced along the groove 18, that is they are symetrically spaced along the length of endless belt 44. The spacing of the engagement members 48 on endless belt 44 is such that if two vehicles, say for instance the vehicles 22 and 24, are engaged on adjacent engagement members 48 there is not enough space between them to allow for the insertion of vehicle 20 between them when the vehicles are located in the right hand section 38. If, however, the two vehicles 22 and 24 are engaged on two engagement members 48 separated by a single engagement member, this allows for sufficient space for the vehicle 20 to fit inbetween the vehicles 22 and 24.

It can be seen that any one of a number of vehicles can be placed on track 12 and engaged with engagement members 48 and driven around groove 18 by the endless belt 44. For the novice user of the game 10, only one vehicle 22 would be used such that there are not too many interference objects interfering with the progress of his vehicle 20 around the track 12. For the more experienced user of the game, however, the use of two or more vehicles engaged with endless belt 44 will provide for a more interesting and stimulating game and requires the more experienced player to adjust the speed of the vehicle 20 by manipulation of the control stick 32 in a variety of movements which would require both stopping and acceleration of the vehicle 20 in order to safely negotiate the vehicle 20 through the right hand section 38 without engaging, bumping or otherwise contacting any of the vehicles which might be positioned adjacent to groove 18.

Both of the endless belts 42 and 44 are flexible plastic members having a continuous rack of gear teeth (not separately numbered) located on one of their side surfaces. As can be seen in FIG. 2 the teeth on the endless belt 42 are positioned such that they can be engaged by a contact gear 50 which on rotation as hereinafter explained will cause the endless belt 44 to rotate within the groove 16. Likewise the teeth on endless belt 44 engage a contact gear 52 such that endless belt 44 is revolved in groove 18 by rotation of contact gear 52. The speed of the movement of endless belts 42 and 44 and thus of vehicles 20, 22 and 24 is therefore governed by the speed of rotation of the contact gears 50 and 52.

Figure 3:
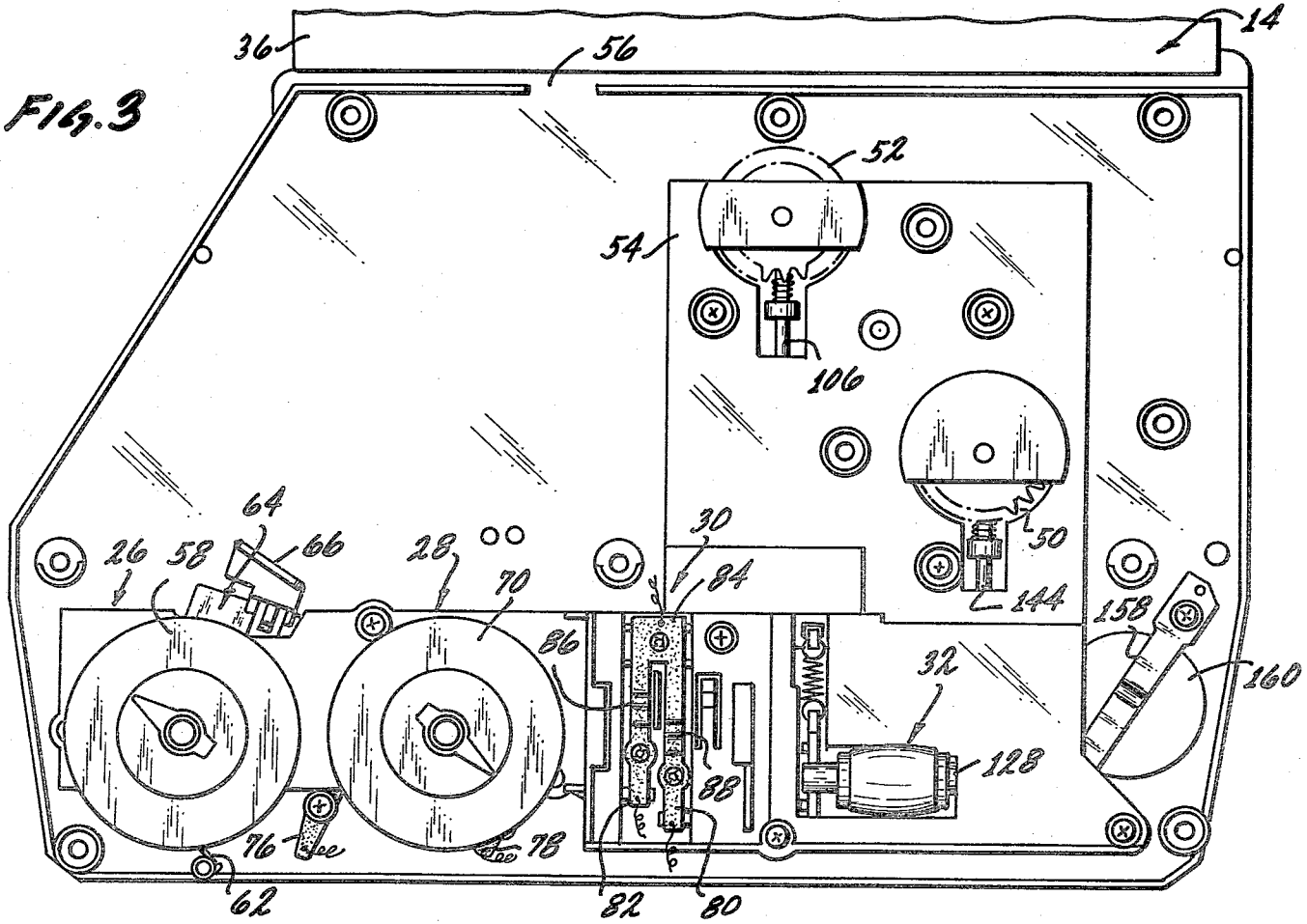
FIG. 3 is a plan view of certain portions of the invention as shown in the lower part of FIG. 1 with some of the overlaying cover components removed.
Figure 4:
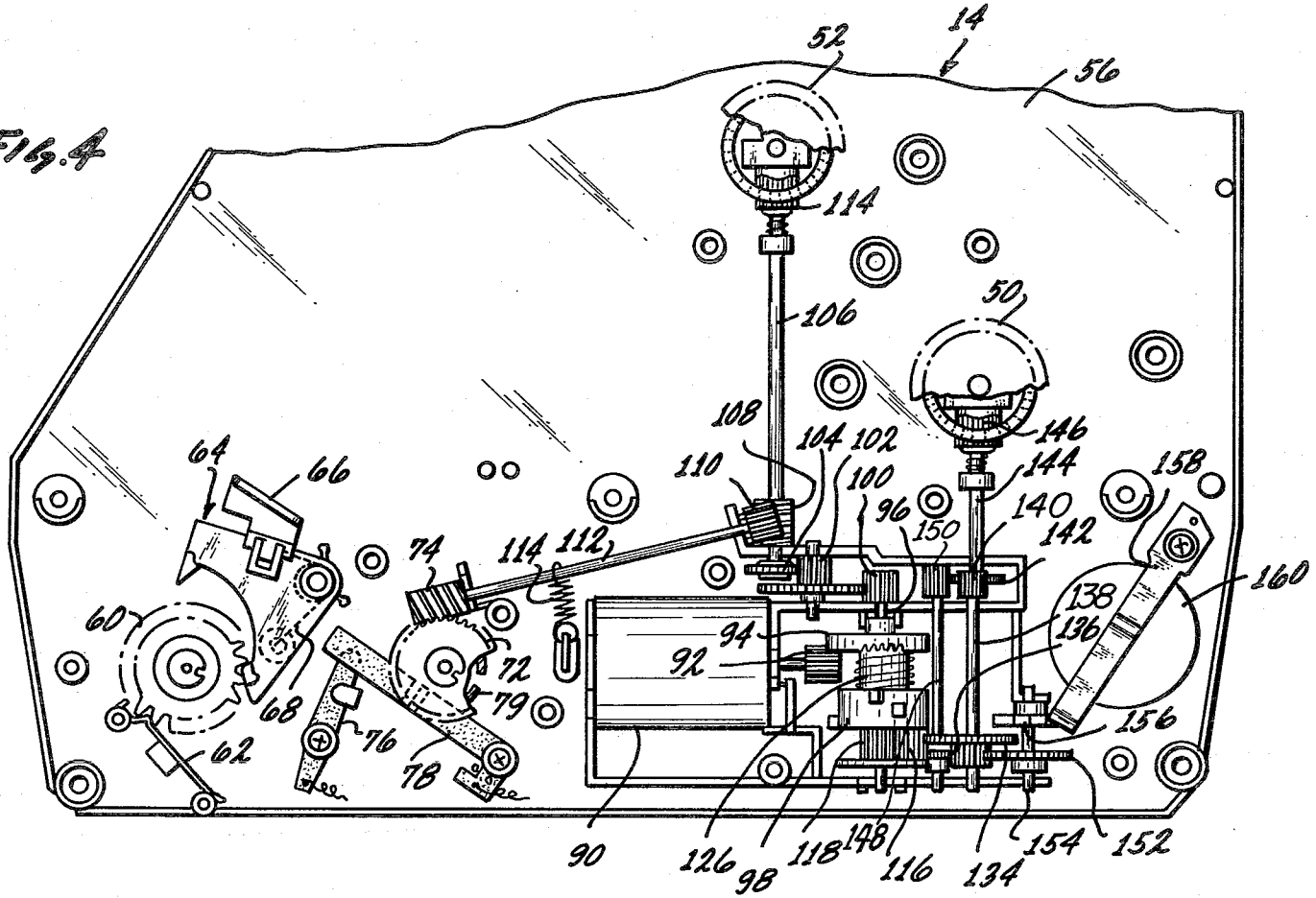
FIG. 4 is a plan view similar to FIG. 3 except additional overlaying components have been removed.

Referring now to FIGS. 3 and 4, in FIG. 3 the overlying housing (not separately numbered) of the control module 14 is removed to show certain parts underneath and in going from FIG. 3 to FIG. 4 an internal housing 54 has been removed to show parts located underneath it. The housing 54 serves as a support surface for certain components as well as an upper bearing surface for other components. The base housing 56 of the control module 14 serves as a support for many of the components as well as bearing surface for many of the moving components and serves to interlock the track portion 12 with the control module 14.

Referring to the left hand portion of FIGS. 3 and 4, included as part of the lap counter 26 is a knurled knob 58. This knob 58 has an appropriate pointer indicia located on its surface. Underneath the knurled knob 58 is a ratchet wheel 60 appropriately rotatively mounted between intermediate housing 54 and base housing 56. A spring member 62 interacts with the ratchet teeth of the ratchet wheel 60 and tends to hold the ratchet wheel in discrete position such that the indicator on the knob 58 will point to certain indicia located on the control module referring to the numerals 1, 2, 3, etc., to indicate the appropriate laps traveled by the vehicle 20. Mounted on an upstanding boss (not separately numbered) is an escapement member 64. The escapement member 64 includes plate 66 which projects out over groove 16. As the vehicle 20 travels about groove 16 and passes the lap counter 20 it strikes and depresses the plate 66 rotating the escapement member 64 in a counterclockwise direction as seen in FIG. 4. The escapement member 64 includes an appropriate spring 68 which biases it clockwise. Each time the plate 66 is struck such that the escapement member 64 rotates counterclockwise the escapement teeth (not separately numbered or identified) on it interact with the ratchet teeth on the ratchet wheel 60 rotating the ratchet wheel 60 one increment such that its pointer will move to the next number. The number of teeth on the ratchet wheel 60 are appropriately governed such that the pointer moves one numeral for each time the plate is depressed.

In FIGS. 3 and 4 moving to the right from the knob 58 is the timing knob 70. The timing knob 70 also includes an appropriate pointer on its surface such that the pointer will move in a clockwise direction as the knob 70 is rotated as hereinafter explained. Located underneath the timing knob 70 and keyed to it is a timing wheel 72. A timing wheel 72 is appropriately rotatively mounted between the intermediate housing 54 and the base housing 56. It has a plurality of gears on its surface (not separately numbered or identified) which interact with worm gear 74. Rotation of worm gear 74 as hereinafter explained causes the timing wheel 72 to rotate which in turn rotates the timing knob 70 and moves its pointer such that the amount of elapsed time used when the off/on switch is in the regulated on mode is indicated on the control module 14.

A first electrical contact strip 76 and a second electrical contact strip 78 are appropriately mounted on upstanding projections on the base housing 56 and project underneath the timing wheel 72. Underneath the timing wheel 72 is an annular flange 79 containing a cut out area. The second electrical contact 78 has a bend in its middle which is V shaped and points upward. When the timing wheel 72 is in a certain position this V shape will fit into the space in the annular flange 79 and the contact 78 will, under its own spring bias, move upwardly breaking electrical contact with the contact 76. When the timing wheel 72 rotates such that the V shape is no longer in the space, the annular flange 79 pushes down against the contact 78 making electrical contact between the contacts 76 and 78 and completing a circuit as hereinafter explained.

Figure 7:
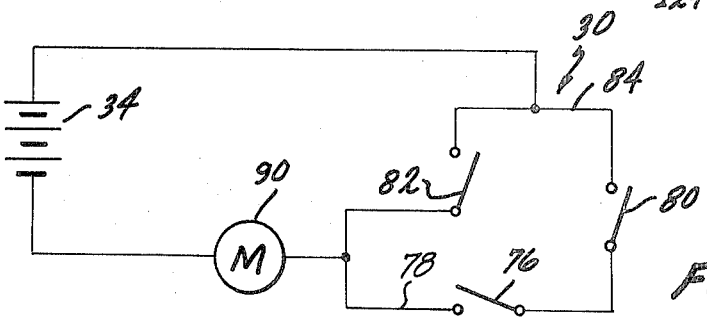
FIG. 7 is an electrical schematic of the invention.

Again moving to the right in FIG. 3 next to the timing knob 70 is a switching area which includes an electrical contact 80, an electrical contact 82 and a complex electrical contact 84 having two arms. The right arm projects over electrical contact 80 and the left arm projects over electrical contact 82. Referring to FIG. 7, in the electrical circuit shown, the same numbers are given to the mechanical elements as are used to identify the circuit elements. The contact 84 can make electrical contact with both electrical contacts 80 and 82 but not simultaneously. Contact 80 is connected to first contact strip 76 which in turn can make electrical contact with contact strip 78 as described above. Contact 82 is wired in parallel with contact strip 78 thus current can flow through switch 84 to contact 80 and in turn to contacts 76 and 78 through to motor 90 or alternately current can flow from contact 84 to contact 82 through motor 90. When the off/on switch 30 is in the continuous on mode electrical contact is made between contacts 84 and 82 driving motor 90 continuously and when the off/on switch 30 is in the regulated on mode, contact is made between contact 84 and contact 80 and electrical circuit through motor 90 is therefore governed by the timer contacts 76 and 78.

Located on the bottom of off/on switch 30 are a first and second detent 86 and 88. The respective arms of electrical contact 84 are bent upwardly. When the off/on switch is in the off mode neither of the detents 86 or 88 come in contact with either of the arms of the electrical contact 84. When the off/on switch 30 is in the continuous on mode the first detent 86 depresses the left hand arm of contact 84 making electrical contact with contact 82. When the off/on switch 30 is in the regulated on mode the right hand detect 88 depresses the right hand arm of contact 84 making electrical contact with contact 80. The left and right hand arms of the contact switch 84 are of different lengths such that when the detent 86 depresses against the right hand arm the detent 88 does not depress the left hand arm and vice versa. In this way the off/on switch 30 controls which mode the motor 90 is in.

To activate the timer 28 the off/on switch 30 must first be moved to the continuous on position to start rotation of the motor 90. The motor 90 rotates certain components as hereinafter explained which causes the timing wheel 72 to start rotating. When it has rotated a sufficient amount the V portion of the contact 76 is freed from the groove and it is depressed downwardly by the flange 79 such that electrical contact is made between contact 76 and 78 and when the off/on switch is then moved to the regulated on mode the control of the motor is through these two contacts.

The motor 90 drives a pinion 92. The pinions 92 in turn engages a crown gear 94. Crown gear 94 is fixedly attached to a shaft 96. A drum 98 is freely rotatable on shaft 96. A pinion 100 is fixedly attached to shaft 96. Pinion 100 engages with gear 102 rotating the same. Gear 102 engaged with gear 104 which is fixedly attached to shaft 106. Fixedly mounted on shaft 106 is worm gear 108. A pinion 110 meshes with worm gear 108 and turns shaft 112. Worm gear 74 is fixedly attached to shaft 112 and rotates in response to rotation of shaft 112. Rotation of the motor 90 is therefore transferred by the above gear train to the timer wheel 72. A spring 114 fixedly holds the worm gear 74 against the timing wheel 72.

Located on the end of shaft 106 is a pinion 114 which engages contact gear 52 and rotates it. This in turn, as noted above, rotates endless belt 44.

Located next to drum 98 and fixedly attached to shaft 96 is a pinion 118. A pinion 116 engages pinion 118. Pinion 116 is located about an axle (not separately numbered or identified) which is formed as a part of drum 98. Rotation of drum 98 therefore rotates this axle which will rotate pinion 116 between the positions shown in FIGS. 5 and 6. Rotation of shaft 96 is transferred to pinion 118 and this rotation is transferred to pinion 116 causing it to rotate about the axle formed as a part of drum 98. Thus rotation of the shaft 96 is ultimately transferred to rotation of the pinion 116 regardless of the position it is located in.

Three detents 120, 122 and 124 are located on the surface on the drum 98. A spring 126 is mounted around shaft 96 and pushes between drum 98 and crown gear 94 maintaining drum 98 in the proper position as shown in FIG. 4.

Figure 5:
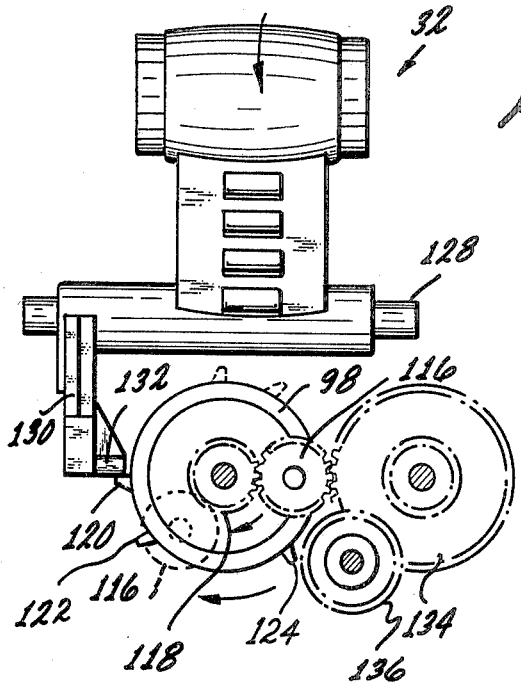
FIG. 5 is a side elevational view in partial section of certain of the components seen in plan view in FIGS. 3 and 4 showing some of these components in solid lines in a first spatial relationship with respect to one another, and in phantom lines in a second spatial relationship with respect to one another.
Figure 6:
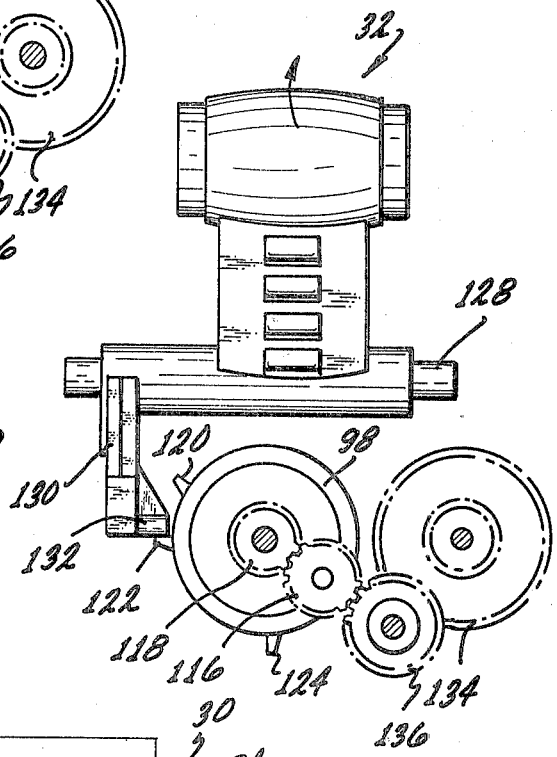
FIG. 6 is a view identical to FIG. 5 except the variable elements of FIG. 5 are shown in a third spacial relationship with respect to one another.

As can be seen in FIGS. 5 and 6 the control stick 32 is complex in shape. A central axle 128 extends through it and pivotally mounts it on projections projecting upwardly from the base housing 56. On the left hand side of control stick 36 is a plate 130 which is integrally formed with the remainder of the control stick. The plate 130 includes a tab 132 located on it.

The detents 120, 122 and 124 aside from being located in different positions with respect to the circumference of the drum 96 as seen in FIGS. 5 and 6, are also spaced away from one another with respect to the thickness of the drum 96 as seen in FIG. 4. By being so placed it is possible for the tab 132 to independently interact with all of the detents 120, 122 and 124 depending on the position of the control stick 32. When the control stick 32 is in the stop mode as previously explained the tab 132 is in position to interact with detent 124. When it is in the neutral position it can interact with detent 122 and in the accelerated position it can interact with detent 120.

As seen in FIG. 5 when the tab 132 interacts with detent 124 the pinion 116 shown in phantom in FIG. 5 is located at about a seven o'clock position and interacts with no other gear other than pinion 118. When the tab 132 interacts with detent 120 as shown in solid lines in FIG. 5, the pinion 116 is moved to approximately the three o'clock position and interacts with a gear 134. When the tab 132 is interacting with detent 122 the pinion 116 is moved to approximately the four o'clock position and interacts with gear 136.

Gear 134 is located on shaft 138 and on the other end of this shaft is a pinion 140. Pinion 140 engages with gear 142 which is located on shaft 144 as is pinion 146. Pinion 146 engages against contact gear 50 and rotates it. Gear 136 is located on shaft 148 as is pinion 150. Pinion 150 also interacts with gear 142 and thus it can be seen that ultimately contact gear 50 can be rotated by either rotation of gear 134 or gear 136. The gearing in the gear trains between gears 134 and 136 and contact gear 50 are such that two speeds of rotation of contact gear 50 are achieved depending on whether pinion 118 is engaged with gear 134 or engaged with gear 136. As was noted above contact gear 50 engages endless belt 42 and thus the speed of the endless belt 42 is dependent on engagement of pinion 116 with gear 134 or gear 136 and when pinion 116 is not engaged with either of these the endless belt 42 ceases to move thus the vehicle 20 stops.

A gear 152 engages with gear 136 and turns shaft 154. Also located on shaft 154 is a ratchet wheel 156. Abutting against ratchet wheel 156 is a clicker arm 158. Clicker arm 158 rests against a rubber diaphragm 160 such that upon rotation of ratchet wheel 156 the arm 158 goes up and down against the diaphragm 160 producing an engine like sound. Because both pinions 140 and 150 are attached to gear 142, gear 136 is always rotating when pinion 118 is in contact with either gear 134 or 136. Thus the noise produced by the interaction of arm 158 with diaphragm 160 is emitted when either of gears 134 or 136 are being rotated by pinion 116. As a consequence of this, noise is produced whenever the vehicle 20 is in motion.

I claim:

1. In a game of the type wherein a housing having a surface is provided with at least two channels depressed below said surface and an endless element moves within each of said channels the improvement which comprises:

at least one first upstanding member attached to one of said endless elements and projecting upwardly from one of said channels wherein said one of said endless elements is located, at least a portion of said first upstanding member projecting above said surface, said projecting portion capable of holding an object;

at least one second upstanding member attached to the other of said elements and projecting upwardly from the other of said channels wherein the other of said elements is located, at least a portion of said second upstanding member projecting above said surface;

a motor located in said housing;

a first transfer means operatively connected between said motor and said one element and capable of moving said element in said one channel, said first upstanding member moving in a continuous pathway above said surface in response to movement of said one element;

a second transfer means operatively connected between said motor and said other element and capable of moving said other element in said other channel, said second upstanding member moving in a second continuous pathway above said surface in response to movement of said other element;

said first and said second continuous pathways converging on a portion of said surface and diverging on the remaining portion of said surface;

a first wheeled vehicle having a plurality of wheels rotatably mounted on axles, said vehicle capable of detachably connecting to said first upstanding member by locating one of said wheels on said projecting portion of said member and said vehicle being moved over said surface as said one upstanding member moves in response to movement of said one element;

a second wheeled vehicle capable of detachably connecting to said second upstanding member and being moved in response to movement of said other element;

said first and said second wheeled vehicles capable of interacting on said portion of said surface wherein said first and said second pathways are convergent, said first and said second wheeled vehicle incapable of interacting on said portion of said surface wherein said first and said second pathway are divergent;

said first transfer means including means capable of regulating the speed of said one of said endless elements in said one channel with respect to the speed of said other of said endless elements in said other channel, said second transfer means maintaining the speed of the other of said endless elements at a constant speed.

2. In a game of the type wherein a housing having a surface is provided with at least two channels depressed below the surface and an endless element moves within each of said channels the improvement which comprises:

at least one first upstanding member attached to one of said endless elements and projecting upwardly from one of said channels wherein said one of said endless elements is located, at least a portion of said first upstanding member projecting above said surface;

at least one second upstanding member attached to the other of said elements and projecting upwardly from the other of said channels wherein the other of said elements is located, at least a portion of said second upstanding member projecting above said surface;

a motor located in said housing;

a first transfer means operatively connected between said motor and said one element and capable of moving said element in said one channel, said first upstanding member moving in a first continuous pathway above said surface in response to movement of said one element;

a second transfer means operatively connected between said motor and said other element and capable of moving said other element in said other channel, said second upstanding member moving in a second continuous pathway above said surface in response to movement of said other element;

said first and said second continuous pathways converging on a portion of said surface and diverging on the remaining portion of said surface;

a first object capable of detachably connecting to said one upstanding member and being moved over said surface as said one upstanding member moves in response to movement of said one element;

a second object capable of detachably connecting to said second upstanding member and being moved over said surface as said second upstanding member moves in response to the movement of said other element;

said first and said second objects capable of interacting on said portion of said surface wherein said first and said second pathways are convergent, said first and said second objects incapable of interacting on said portion of said surface wherein said first and said second pathway are divergent;

said first transfer means including means capable of regulating the speed of said one of said endless elements in said one channel with respect to the speed of said other of said endless elements in said other channel;

said means capable of regulating the speed of said one of said elements is capable of regulating said speed in a first manner such that one of said elements is capable of moving at a faster rate of travel within said one channel than the rate of travel of the other of said elements in said other channel and in a second manner at a rate of speed approximately equal to the rate of speed of the other of said elements in said other channel and in a third manner at a rate of speed sufficiently less than the rate of speed of the other of said elements in the other of said channels;

said second object is capable of severing said detachable connection of said first object with said first upstanding member when said first and said second objects interact;

said first gear train includes a first contact gear and a second contact gear, both said first and said second contact gears capable of rotating said first gear train, said first contact gear capable of rotating said first gear train at a first speed and said second contact gear capable of rotating said first gear train at a second speed;

said means capable of regulating the speed of said one of said endless elements includes an operator control member and a gear train shifting member;

a portion of said operator control member located outside of said housing in a position to be acted on by the operator of said game and a second portion of said operator control member operatively associated with said gear train shifting member, said gear train shifting member including a control gear, said control gear movable between at least a first position wherein it is engaged with said first contact gear, a second position wherein it is engaged with said second contact gear and a third position wherein it is engaged with neither of said first or said second contact gears, said control gear movable between said positions in response to movement of said portion of said operator control member located outside of said housing.

3. The game of claim 2 including:

a plurality of second upstanding members, each of said second members attached to the other of said endless elements and having a portion projecting upwardly above said surface, each of said plurality of second upstanding members spaced away from each other along said other of said endless elements;

a plurality of second objects, each of said plurality of said second objects capable of independently detachably connecting to one of said plurality of said upstanding members;

said spacing between said plurality of said second members is such that two of said plurality of said second objects can be located with respect to each other so as the spacing between said two of said second objects can in a first instance be greater than the size of said first object allowing said first object to become at least partially located between said two second objects along said convergent portion of said pathway and in a second instance be less than the size of said first object not allowing said first object to be located between said two second objects along said convergent portion of said pathway.

4. The game of claim 3 including:

indicating means located at a position on said surface and operatively associated with said one of said channels;

in response to maintaining said connection of said first object with said first upstanding member as said first upstanding member moves in said first continuous pathway said first object being moved over said surface in a cyclic manner past said position wherein said indicator means is located;

said indicating means indicating the number of said cycles.

5. The game of claim 4 including:

control means operatively connected to said motor and capable of controlling said motor between at least an off position, a continuous on position and a regulated on position;

timer means operatively associated with said control means and capable of maintaining said motor in said regulated on position for a regulated period.

6. The game of claim 3 including:

indicating means located at a position on said surface and operatively associated with said one of said channels;

in response to maintaining said connection of said first object with said first upstanding member as said first upstanding member moves in said first continuous pathway said first object being moved over said surface in a cyclic manner past said position wherein said indicator means is located;

said indicating means indicating the number of said cycles;

control means operatively connected to said motor and capable of controlling said motor between at least an off position, a continuous on position and a regulated on position;

timer means operatively associated with said control means and capable of maintaining said motor in said regulated on position for a regulated period.

7. In a game of the type wherein a housing having a surface is provided with at least two channels depressed below said surface and an endless element moves within each of said channels the improvement which comprises:

at least one first upstanding member attached to one of said endless elements and projecting upwardly from one of said channels wherein said one of said endless elements is located, at least a portion of said first upstanding member projecting above said surface;

at least one second upstanding member attached to the other of said elements and projecting upwardly from the other of said channels wherein the other of said elements is located, at least a portion of said second upstanding member projecting above said surface;

a motor located in said housing;

a first transfer means operatively connected between said motor and said one element and capable of moving said element in said one channel, said first upstanding member moving in a continuous pathway above said surface in response to movement of said one element;

a second transfer means operatively connected between said motor and said other element and capable of moving said other element in said other channel, said second upstanding member moving in a second continuous pathway above said surface in response to movement of said other element;

said first and said second continuous pathways converging on a portion of said surface and diverging on the remaining portion of said surface;

a first object capable of detachably connecting to said one upstanding member and being moved over said surface as said one upstanding member moves in response to movement of said one element;

a second object capable of detachably connecting to said second upstanding member and being moved over said surface as said second upstanding member moves in response to the movement of said other element;

said first and said second objects capable of interacting on said portion of said surface wherein said first and said second pathways are convergent, said first and said second object incapable of interacting on said portion of said surface wherein said first and said second pathways are divergent;

said first transfer means including means capable of regulating the speed of said one of said endless elements in said one channel with respect to the speed of said other of said elements in said other channel;

said first transfer means includes a first gear train and a first drive gear, said first gear train operatively connecting between said motor and a first drive gear, said first drive gear operatively associated with said one of said endless element and capable of moving said one endless element in response to rotation of said first gear train;

said second transfer means includes a second gear train and a second drive gear, said second gear train operatively connecting between said motor and a second drive gear, said second drive gear operatively associated with said other endless element and capable of moving said other endless element in response to rotation of said second gear train;

said first gear train includes a first contact gear and a second contact gear, both said first and said second contact gears capable of rotating said first gear train, said first contact gear capable of rotating said first gear train at a first speed and said second contact gear capable of rotating said first gear train at a second speed;

said means capable of regulating the speed of said one of said endless elements includes an operator control member and a gear train shifting member;

a portion of said operator control member located outside of said housing in a position to be acted on by the operator of said game and a second portion of said operator control member operatively associated with said gear train shifting member, said gear train shifting member including a control gear, said control gear movable between at least a first position wherein it is engaged with said first contact gear, a second position wherein it is engaged with said second contact gear and a third position wherein it is engaged with neither of said first or said second contact gears, said control gear movable between said positions in response to movement of said portion of said operator control member located outside of said housing.

8. The game of claim 7 wherein:

said means capable of regulating the speed of said one of said elements is capable of regulating said speed in a first manner such that said one of said elements is capable of moving at a faster rate of travel within said one channel than the rate of travel of the other of said elements in said other channel and in a second manner at a rate of speed approximately equal to the rate of speed of the other of said elements in said other channel and in a third manner at a rate of speed sufficiently less than the rate of speed of the other of said elements in the other of said channels.

9. The game of claim 8 wherein:

said second object is capable of severing said detachable connection of said first object with said first upstanding member when said first and said second objects interact.

10. The game of claim 9 including:

indicating means located at a position on said surface and operatively associated with said one of said channels;

in response to maintaining said connection of said first object with said first upstanding member as said first upstanding member moves in said first continuous pathway said first object being moved over said surface in a cyclic manner past said position wherein said indicator means is located;

said indicating means indicating the number of said cycles.

11. The game of claim 10 including:

control means operatively connected to said motor and capable of controlling said motor between at least an off position, a continuous on position and a regulated on position.

12. The game of claim 11 including:

timer means operatively associated with said control means and capable of maintaining said motor in said regulated on position for a regulated period.

13. The game of claim 9 wherein:

said first transfer means includes a first gear train and a first drive gear, said first gear train operatively connecting between said motor and a first drive gear, said first drive gear operatively associated with said one endless element and capable of moving said one endless element in response to rotation of said first gear train;

said second transfer means includes a second gear train and a second drive gear, said second gear train operatively connecting between said motor and a second drive gear, said second drive gear operatively associated with said other endless element and capable of moving said other endless element in response to rotation of said second gear train.

14. The game of claim 9 including:

a plurality of second upstanding members, each of said second members attached to the other of said endless elements and having a portion projecting upwardly above said surface, each of said plurality of second upstanding members spaced away from each other along said other of said endless elements;

a plurality of second objects, each of said plurality of said second objects capable of independently releasably connecting to one of said plurality of said upstanding members.

15. The game of claim 14 wherein:

said spacing between said plurality of said second members is such that two of said plurality of said second objects can be located with respect to each other so as the spacing between said two of said second objects can in a first instance be greater than the size of said first object allowing said first object to become at least partially located between said two second objects along said convergent portion of said pathway and in a second instance be less than the size of said first object not allowing said first object to be located between said two second objects along said convergent portion of said pathway.

* * * * *